US005389500A

United States Patent [19]

Shimazaki et al.

[11] Patent Number: 5,389,500

[45] Date of Patent: Feb. 14, 1995

[54] METHOD FOR FORMING COLOR PHOTOGRAPHIC IMAGES IMPROVED IN COLOR REPRODUCTION

[75] Inventors: Hiroshi Shimazaki; Kuniaki Uezawa; Satoru Shimba; Yoshitaka Yamada, all of Hino, Japan

[73] Assignee: Konica Corporation, Japan

[21] Appl. No.: 139,334

[22] Filed: Oct. 19, 1993

Related U.S. Application Data

[63] Continuation of Ser. No. 841,359, Feb. 25, 1992, abandoned.

[30] Foreign Application Priority Data

Mar. 1, 1991 [JP] Japan ..... 3-059542

[51] Int. Cl.[6] ..... G03C 7/46; G03C 1/08; G03C 1/005; G03C 1/494

[52] U.S. Cl. ..... 430/386; 430/387; 430/558; 430/576; 430/581; 430/582; 430/583

[58] Field of Search ..... 430/386, 387, 558, 576, 430/581, 582, 583

[56] References Cited

U.S. PATENT DOCUMENTS 4,828,969 5/1989 Takada et al. ..... 430/583
5,300,407 4/1994 Matsuoka et al. ..... 430/386
5,330,887 7/1994 Hasebe et al. ..... 430/558

FOREIGN PATENT DOCUMENTS 295716 12/1988 European Pat. Off. .
160449 7/1987 Japan .
183249 7/1990 Japan .

*Primary Examiner*—Charles L. Bowers, Jr.
*Assistant Examiner*—J. Pasterczyk
*Attorney, Agent, or Firm*—Bierman and Muserlion; Jordan B. Bierman

[57] ABSTRACT

Disclosed is a method for forming color photographic images which comprises printing of color images obtained by use of a color photographic light-sensitive material, having on a support, a blue-sensitive silver halide emulsion layer, a green-sensitive silver halide emulsion layer and a red-sensitive silver halide emulsion layer onto a printing color photographic light-sensitive material having on a support, a yellow color forming layer, a magenta color forming layer and a cyan color forming layer, wherein the following requirements (A) and (B) are fulfilled, (A) wavelength $\lambda_B^{max}$ to give the maximum value in spectral sensitivity distribution of a blue-sensitive silver halide emulsion layer is within the limits of 415 nm to 470 nm, and the sensitivity of the blue-sensitive emulsion layer at 480 nm is not more than 35% of the sensitivity at $\lambda_B^{max}$, (B) a magenta color forming layer of the printing color photographic light-sensitive material comprises a magenta coupler selected from the compounds represented by Formula 1;

Formula 1 wherein Z represents a group of non-metal atoms necessary to form a nitrogen-containing heterocyclic ring, which may have a substituent, X represents a hydrogen atom, or a group capable of undergoing splitting off reaction with an oxidation product of a color developing agent, R represents a hydrogen atom or a substituent.

5 Claims, 2 Drawing Sheets

METHOD FOR FORMING COLOR PHOTOGRAPHIC IMAGES IMPROVED IN COLOR REPRODUCTION

This application is a continuation of application No. 07/841,359, filed Feb. 25, 1992, now abandoned.

FIELD OF THE INVENTION

The present invention relates to a method of forming color photographic images excellent in color reproduction, particularly to a method of forming color photographic images excellent in hue reproduction, especially in reproduction of blue-green.

BACKGROUND OF THE INVENTION

Silver halide multilayered color photographic material is making marked progress toward high image qualities. In recent color photographic light-sensitive materials, graininess, sharpness and color reproduction, which are three major requisites for image quality, have been improved to a considerably high level. In the case of color photographs for popular use, for example, color prints or color slides which come to customers' hands, seem to be accepted without particular dissatisfaction.

Among these three requisites for image quality, color reproduction has certainly been improved to provide a pure color. But sufficient improvement has not been made so far and problems still remain unsolved in reproduction of colors which are regarded to be difficult to duplicate in photography. Purple, violet, blue-green and yellow-green, for example, which reflect light having a wavelength longer than 600 nm, are liable to be reproduced as a color quite different from the original, causing disappointment among customers.

The primary factors which affect color reproduction are spectral sensitivity distribution and inter-image effect.

With respect to the inter-image effect which functions in a silver halide multilayered color photographic light-sensitive material, it is known that the so-called DIR compound which forms a developing inhibitor or its precursor by reacting with an oxidation product is added to a light-sensitive material, and that the released developing inhibitor generates an inter-image effect which improves color reproduction by controlling development in other color forming layers.

In addition, an effect similar to the inter-image effect can be provided in a color negative film, by use of a colored coupler in an amount larger than necessary to offset useless absorptions.

However, use of a colored coupler in large amounts raises the minimum density of a film and thereby makes it difficult to judge the correction of color and density in printing. As a result, deterioration in color quality of finished prints is apt to occur.

These techniques contribute particularly to the improvement of color purity in the category of color reproduction. And the so-called diffusive DIR compound, which is widely used for its capability of releasing an inhibitor or its precursor having a large mobility, greatly contributes to the improvement in such color purity.

In contrast with these advantages, the inter-image effect has a problem in that the direction in which it is exerted is difficult to control; accordingly, colors are occasionally reproduced in different hues, though improved in purity. U.S. Pat. No. 4,725,529 discloses a method for controlling the direction of the inter-image effect.

U.S. Pat. No. 3,672,898 discloses a spectral sensitivity distribution appropriate for lessening the fluctuation in color reproduction caused by difference in light sources for photographing. But this cannot be a means to improve the color reproduction of the foregoing less reproducible colors.

Japanese Patent O.P.I. Publication No. 34541/1986 attempts to improve the reproduction of those colors which are difficult to reproduce on color films by use of the inter-image effect, including a combined use of the inter-image effect with the spectral sensitivity distribution, and it seems to be effective to some extent.

The typical attempt disclosed therein is to exert an inter-image effect not only from the respective central wavelengths of a blue-sensitive layer, green-sensitive layer and red-sensitive layer as usually done, but also from regions other than the central wavelengths of the respective layers.

This technique is slightly effective in improving the color reproduction when applied to a limited number of specific colors, but it requires that an inter-image effect generation layer be formed by use of another light-sensitive silver halide, in addition to the ordinary blue-sensitive, green-sensitive and red-sensitive layers. This increases the amount of silver consumed as well as the number of manufacturing processes, and thereby raises the manufacturing cost. In addition, the effect is not necessarily satisfactory.

Japanese Patent O.P.I. Publication No. 183249/1990 discloses a technique to improve the depiction in a red shadow portion by combining a photographing light-sensitive material, whose red-sensitive silver halide emulsion layer is formed to have a spectral sensitivity distribution in a shorter wavelength region, with a printing light-sensitive material containing a pyrazoloazole type magenta coupler having little useless absorption in the red region. The spectral sensitivity distribution of the red-sensitive silver halide emulsion layer disclosed therein is the same as that disclosed in Japanese Patent Examined Publication No. 6207/1974.

Red light is light having reflection in the wavelength region larger than 600 nm; accordingly, shifting the spectral sensitivity distribution of a red-sensitive silver halide emulsion layer to a shorter wavelength region lowers the spectral sensitivity to red light and thereby makes a red color region turbid. Though a pure red light is also made turbid at this time, the drop in purity of the red color is minimized by combination with a printing light-sensitive material containing a magenta coupler having little absorption in the red region. By use of this technique, the depiction in a red shadow region can be reproduced with turbidness, in addition, this mitigates the problem with purple and violet, having reflection on the long wavelength side of the red light region, which are liable to be reproduced tinged with red. However, this technique is inadequate for blue-green, which is still reproduced in a different color.

For example, the blue-green having a spectral reflection distribution shown in FIG. 1 is seen as blue-green close to green to human eyes, but it turns blue with little green tinge when reproduced by use of this technique.

OBJECT OF THE INVENTION

The object of the invention is to provide a method of forming color photographic images, which can form a color photograph having a reproduced blue-green close to that seen by human eyes without lowering the quality of other colors satisfactorily reproduced in the present art, and give full satisfaction in color reproduction.

DETAILED DESCRIPTION OF THE INVENTION

The present inventors made studies in particular on both the photographing light-sensitive material and the printing light-sensitive material, and have found that the object of the invention is achieved by the following constitution. That is, not only blue-green but also other colors can be satisfactorily reproduced by a method of forming color photographic images which comprises printing of color images obtained by use of a photographing color photographic light-sensitive material, having on a support, a blue-sensitive silver halide emulsion layer, green-sensitive silver halide emulsion layer and red-sensitive silver halide emulsion layer onto a printing color photographic light-sensitive material having, on a support, a yellow color forming layer, magenta color forming layer and cyan color forming layer, wherein the following requirements (A) and (B) are satisfied.

(A) Wavelength $\lambda_B^{max}$ to give the maximum value in spectral sensitivity distribution S (λ) of a blue-sensitive silver halide emulsion layer is within the limits of 415 nm to 470 nm, and the sensitivity of the blue-sensitive emulsion layer at 480 nm, $S_B^{480}$, is not more than 35% of the sensitivity at $\lambda_B^{max}$, $S_B^{max}$.

(B) A magenta color forming layer of the printing color photographic light-sensitive material contains a magenta coupler selected from the compounds represented by Formula 1.

Formula 1

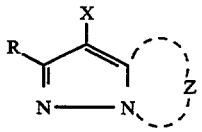

In Formula 1 which expresses a magenta coupler, Z represents a group of nonmetal atoms necessary to form a nitrogen-containing heterocycle, which may have a substituent; X represents a hydrogen atom, or a group capable of splitting off upon reaction with an oxidation product of a color developing agent; and R represents a hydrogen atom or a substituent.

In the invention, the spectral sensitivity distribution is given as a function of wavelength, on condition that when a light-sensitive material sample is subjected to homochromatic exposure at intervals of several nanomicrons in a 400 to 700 nm region, a reciprocal of the exposure to give a density of minimum density (hereinafter referred to as $D_{min}$)+0.7 to the processed sample at each wavelength is taken as a spectral sensitivity at each wavelength.

The spectral sensitivity distribution obtained as above with the emulsion layers of sample 102 in Example 1 is shown in FIG. 2.

Wavelength $\lambda_B^{max}$, which gives a maximum value in the spectral sensitivity distribution of a blue-sensitive silver halide emulsion layer of the photographing light-sensitive material used in the invention, is within the limits of 415 nm≦$\lambda_B^{max}$≦470 nm, preferably 420 nm≦$\lambda_B^{max}$≦460 nm, and especially 450plus or minus 10 nm.

According to the findings of the present inventors, when the value of $\lambda_B^{max}$ is smaller than 415 nm, the color reproduction becomes liable to be influenced by change in color temperature of a light source, and thereby its faithful execution can be hardly expected. That is, use of a low color temperature like a tungsten lamp heavily tinges a reproduced color with yellow, and use of a high color temperature gives a bluish tone. On the contrary, a value of $\lambda_B^{max}$ larger than 470 nm lowers the purity of reproduced yellow and heavily impairs the reproduction of blue-green, which the invention specifically aims at, and thus prevents providing a green tone.

It is also necessary that the sensitivity of a blue-sensitive silver halide emulsion layer at 480 nm be not more than 35% especially not more than 25% of the sensitivity of the layer at $\lambda_B^{max}$. When this value is larger than 35% the reproduction of the objective blue-green is hardly achieved.

To provide the blue-sensitive silver halide emulsion layer with the spectral sensitivity distribution of the invention, there may be used various means such as a means to sensitize spectrally a silver halide to an objective wavelength region by use of a sensitizing dye, a means to impart an objective spectral sensitivity to a silver halide by optimizing its halide composition or silver halide distribution without aid of a sensitizing dye, a means to modify the spectral sensitivity distribution to an objective one by incorporating a suitable optical absorbent in the light-sensitive material, or a combination of these means.

The following are typical examples of the sensitizing dye used to obtain the abovementioned spectral sensitivity distribution in the blue-sensitive silver halide emulsion layer of a light-sensitive material according to the invention.

A-1

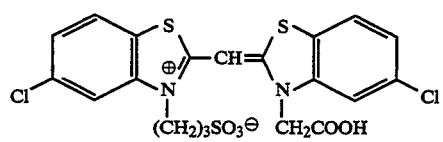

A-2

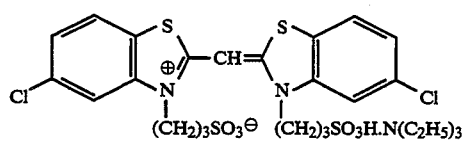

A-3

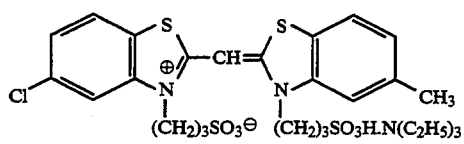

A-4

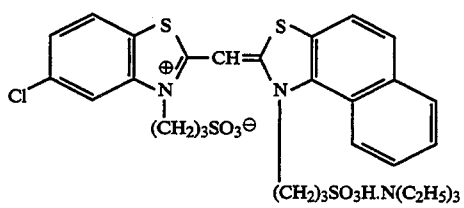

-continued

A-5

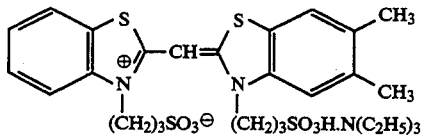

A-6

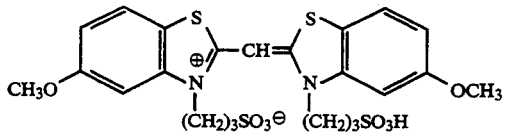

A-7

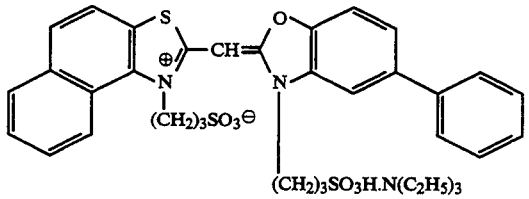

A-8

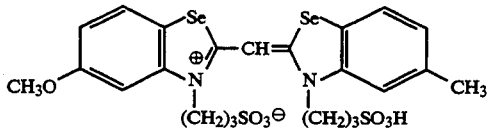

A-9

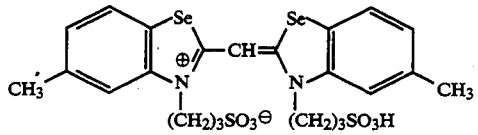

A-10

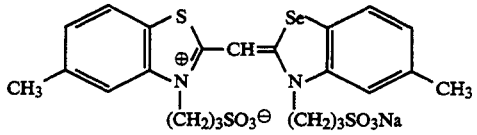

A-11

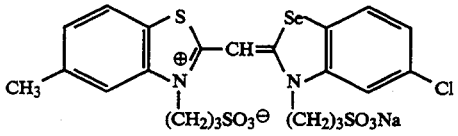

A-12

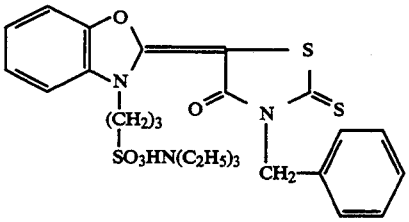

With respect to a printing color photographic light-sensitive material to be combined with a photographing color photographic light-sensitive material, it is well known that the absorption by a coupler, after it forms a color, has a large effect on color reproduction. Any of yellow, magenta and cyan couplers increases the purity of a reproduced color with the decrease of its useless absorption other than the primary absorption. It was conceived that improvement in color reproduction of the objective blue-green should be made by increasing the absorption of the blue-light region in the useless absorption of a cyan coupler as well as decreasing the absorption of the green-light region in that, in order to impart a green tone to the cyan color itself. But attempts made with such a conception proved unsuccessful, tinging a reproduced blue or cyan color with green and thereby causing an insufficient color reproduction lacking in blue tone.

The magenta coupler having the structure represented by Formula 1 is known to be low in useless absorption; accordingly, it is easily conceivable that use of this compound improves the reproduction of pure colors such as magenta, red and blue.

However, it is found that the color reproduction of blue-green can be scarcely improved when a printing light-sensitive material containing a magenta coupler of Formula 1 is combined with a photographing light-sensitive material whose spectral sensitivity distribution of a blue-sensitive silver halide emulsion layer deviates from the constitution of the invention, and that the color reproduction of blue-green can be noticeably improved only when a photographing light-sensitive material satisfying the requirement (A) of the invention is used in combination.

Next, an explanation will be made of the magenta coupler for a printing light-sensitive material according to the requirement (B) of the invention.

Formula 1

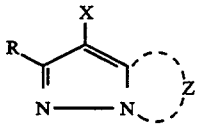

In Formula 1 representing the magenta coupler, Z is a group of nonmetal atoms necessary to form a nitrogen-containing heterocycle, which may have a substituent; X is a hydrogen atom or a group capable of splitting off upon reaction with an oxidation product of a color developing agent; and R is a hydrogen atom or a substituent.

The substituent represented by R in Formula 1 is not particularly limited; typical examples thereof are alkyl, aryl, anilino, acylamino, sulfonamido, alkylthio, arylthio, alkenyl and cycloalkyl groups; and other examples include halogen atoms and cycloalkenyl, alkynyl, heterocyclic, sulfonyl, sulfinyl, phosphonyl, acyl, carbamoyl, sulfamoyl, cyano, alkoxy, aryloxy, heterocycloxy, siloxy, acyloxy, carbamoyloxy, amino, alkylamino, ureido, sulfamoylamino, alkoxycarbonylamino, aryloxycarbonylamino, alkoxycarbonyl, aryloxycarbonyl and heterocyclothio groups, as well as spiro compound radicals and bridged hydrocarbon radicals.

Preferable ranges and typical examples of the substituent represented by R, the group capable of splitting off upon reaction with an oxidation product of a color developing agent, the nitrogen-containing heterocycle formed by Z and the substituent the ring formed by Z may have, as well as a preferable range of the magenta coupler represented by Formula 1 (Formula [M-1]), are the same as those described from the 18th line of the 3rd page to the 7th line of the 6th page of European Patent Publication No. 0273712.

Typical examples of the magenta coupler represented by Formula 1 are exemplified below.

M-1
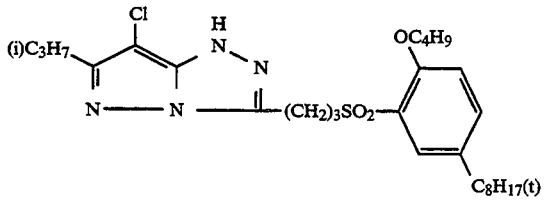
M-2
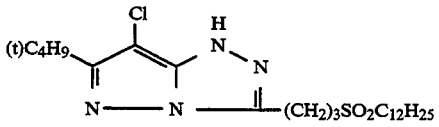
M-3
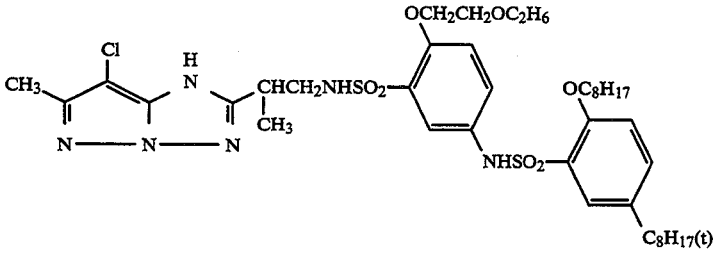
M-4
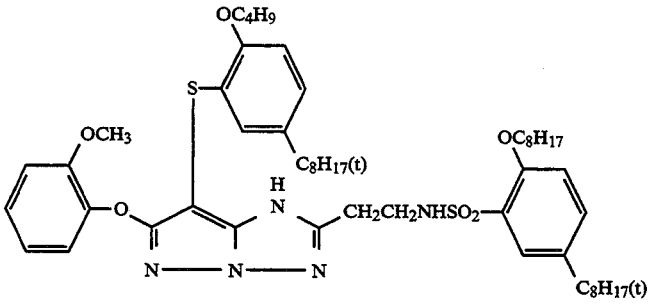
M-5
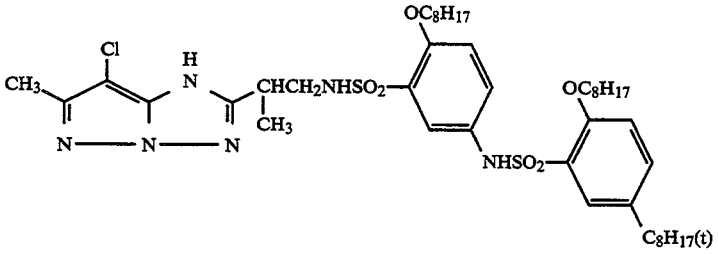
M-6
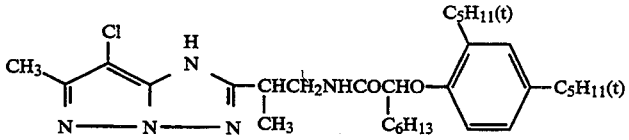
M-7
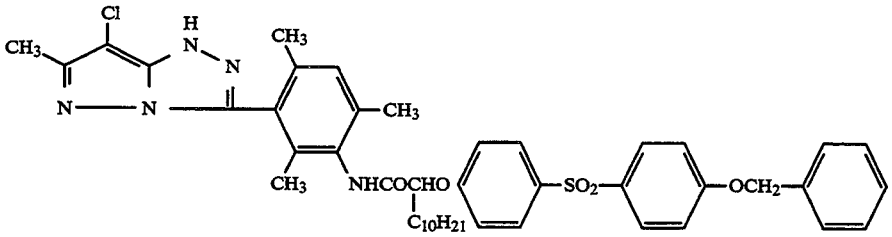
M-8
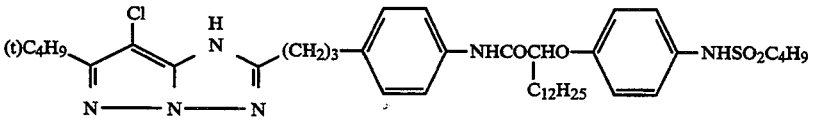

-continued
M-9
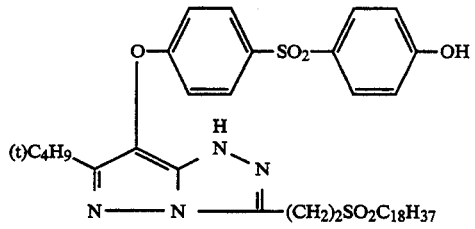
M-10
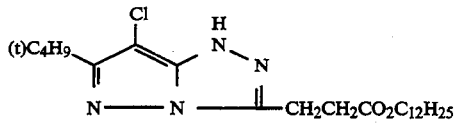
M-11
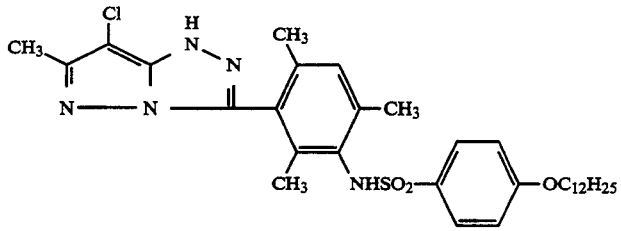
M-12
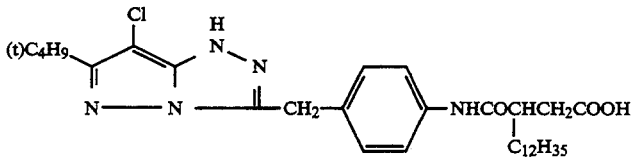
M-13
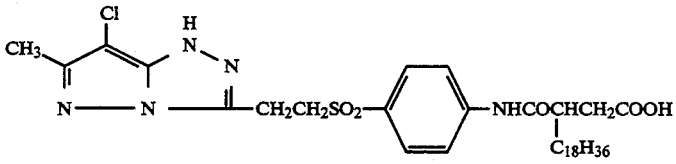
M-14
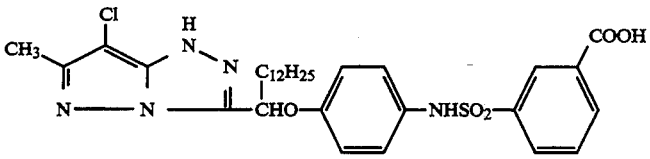
M-15
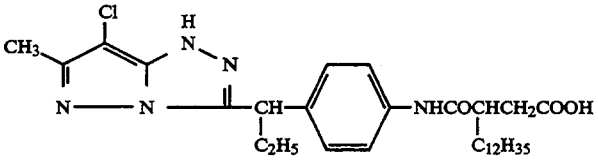
M-16
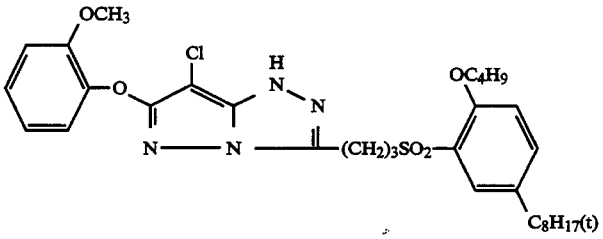

-continued

M-17

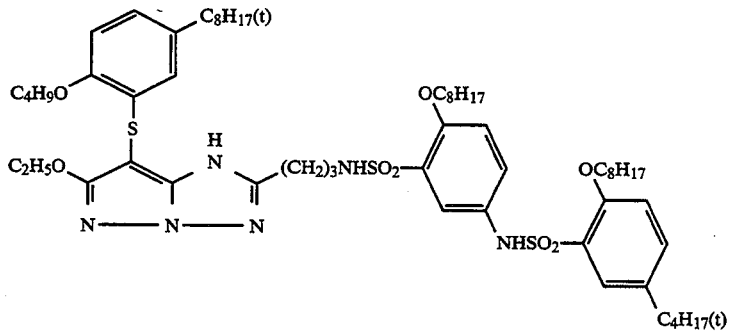

M-18

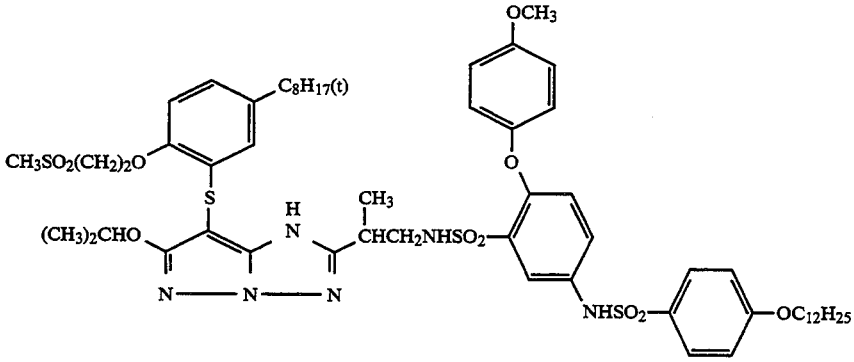

M-19

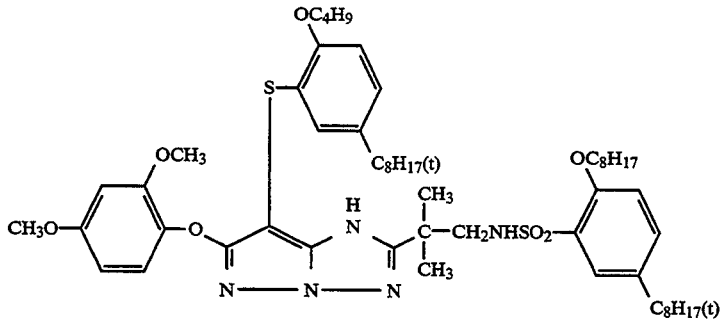

Other examples of the magenta coupler include compounds M-1 to M-61 exemplified from the 6th page to the 21st page of European Patent Publication No. 0273712 and compounds 1 to 223 exemplified from the 36th page to the 92nd page of European Patent Publication No. 0235913.

The above couplers can be synthesized by referring to the methods described in Journal of the Chemical Society, Perkin 1 (1977), 2047-2052, U.S. Pat. No. 3,725,067 and Japanese Patent O.P.I. Publication. Nos. 9943/1984, 42045/1983, 162548/1984, 171956/1984, 83552/1985, 43659/1985, 172982/1985, 190779/1985, 209457/1987 and 307453/1988.

These couplers may be used singly, or together with other types of coupler, in an amount of usually $1\times10^{-3}$ mole to 1 mole, preferably $1\times10^{-2}$ mole to $8\times10^{-1}$ mole per mole of silver halide.

When the coupler of the invention is used in conjunction with other types of coupler, it is preferable that ones having the structure given by Formula 1 amount at least to 70 mole %.

In addition to a coupler for color formation, the color photographic light-sensitive material of the invention may contain, in its emulsion layer, a colored coupler, a competitive coupler, or a compound capable of releasing, upon reaction with an oxidation product of a developing agent, a photographically useful fragment such as developing accelerator, bleaching accelerator, developing agent, silver halide solvent, toning agent, hardener, foggant, antifoggant, chemical sensitizer, spectral sensitizer or desensitizer.

In the light-sensitive material, there may be provided auxiliary layers such as a filter layer, an antihalation layer and an anti-irradiation layer. A dye, which is washed away from the light-sensitive material or bleached during processing, may be contained in these layers and/or emulsion layers.

In the invention, a silver halide emulsion described in Research Disclosure No. 308119 (hereinafter abbreviated to RD308119) may be employed.

A silver halide emulsion used in the invention is subjected to physical ripening, chemical ripening and spectral sensitization before it is used. Examples of the additive used in these processes can be seen in Research Disclosure Nos. 17643, 18716 (hereinafter abbreviated as RD17643 and RD18716, respectively) and 308119.

A variety of couplers may be used in the invention, typical examples thereof are described in the above numbers of Research Disclosure.

The additives used in the invention can be incorporated in a light-sensitive material, for example, by the dispersion method described in RD308119, XIV.

In the invention, there may be used a support described in RD17643, p.28, RD18716, pp.647-8 and RD308119, XIX.

The light-sensitive material of the invention may have auxiliary layers such as a filter layer and an intermediate layer described in RD308119, VII, section K.

The light-sensitive material of the invention may have any of the layer configurations of conventional layer order, inverted layer order and unit structure described in RD308119, VII, section K.

As the support, there may be used paper laminated with polyethylene or the like, baryta paper, polyethylene terephthalate film and cellulose triacetate film.

The invention is applicable to a variety of color light-sensitive materials represented by color negative film for popular use or for movies, reverse color film for slides or TV, color paper, color positive film and color reverse paper.

In forming dye images by use of an exposed light-sensitive material of the invention, a conventional color developing process can be applied.

The light-sensitive material of the invention can be processed in accordance with conventional methods described in RD17643, pp.28-29, RD18716, p.647 and RD308119, XIX.

EXAMPLES

The following examples are presented to illustrate the invention more particularly, but the scope of the invention is by no means limited to them.

In all the examples, addition amounts to the silver halide photographic light-sensitive material are given in grams per $m^2$ unless otherwise specified. Amounts of silver halide and colloidal silver are amounts of silver present. Amounts of sensitizing dye are moles per mole of silver halide contained in the same layer.

Preparation of Photographing Color Negative Film

A multilayer color photographic light-sensitive material, sample 1, was prepared by forming the layers of the following composition in numerical order on a triacetyl cellulose film support.

| Sample 101 Comparison | |
|---|---|
| 1st layer: antihalation layer HC-1 | |
| Black colloidal silver | 0.20 |
| UV absorbent UV-1 | 0.20 |
| High boiling solvent Oil-1 | 0.20 |
| Gelatin | 1.5 |
| 2nd layer: intermediate layer IL-1 | |
| UV absorbent UV-1 | 0.01 |
| High boiling solvent Oil-1 | 0.01 |
| Gelatin | 1.2 |
| 3rd layer: low speed red-sensitive emulsion layer RL | |
| Silver iodobromide emulsion Em-1 | 0.7 |
| Sensitizing dye SD-1 | $2.2 \times 10^{-4}$ (mole/mole Ag) |
| Sensitizing dye SD-2 | $6.6 \times 10^{-4}$ (mole/mole Ag) |
| Cyan coupler C-1 | 0.65 |
| Colored cyan coupler CC-1 | 0.12 |
| DIR compound D-1 | 0.004 |
| DIR compound D-2 | 0.04 |
| High boiling solvent Oil-1 | 0.6 |
| Gelatin | 1.5 |
| 4th layer: high speed red-sensitive emulsion layer RH | |
| Silver iodobromide emulsion Em-2 | 0.8 |
| Sensitizing dye SD-1 | $1.7 \times 10^{-4}$ (mole/mole Ag) |
| Sensitizing dye SD-2 | $3.4 \times 10^{-4}$ (mole/mole Ag) |

-continued

| Sample 101 Comparison | |
|---|---|
| Cyan coupler C-2 | 0.13 |
| Cyan coupler C-3 | 0.02 |
| Colored cyan coupler CC-1 | 0.03 |
| DIR compound D-1 | 0.001 |
| DIR compound D-2 | 0.02 |
| High boiling solvent Oil-1 | 0.2 |
| Gelatin | 1.3 |
| 5th layer: intermediate layer IL-2 | |
| Gelatin | 0.7 |
| 6th layer: low speed green-sensitive emulsion layer GL | |
| Silver iodobromide emulsion Em-1 | 0.8 |
| Sensitizing dye SD-3 | $3.5 \times 10^{-4}$ (mole/mole Ag) |
| Sensitizing dye SD-4 | $8.5 \times 10^{-4}$ (mole/mole Ag) |
| Magenta coupler M-1 | 0.5 |
| Magenta coupler M-2 | 0.05 |
| Colored magenta coupler CM-1 | 0.1 |
| DIR compound D-3 | 0.02 |
| DIR compound D-4 | 0.005 |
| High boiling solvent Oil-2 | 0.4 |
| Gelatin | 1.0 |
| 7th layer: high speed green-sensitive layer GH | |
| Silver iodobromide emulsion Em-2 | 0.8 |
| Sensitizing dye SD-3 | $2.5 \times 10^{-4}$ (mole/mole Ag) |
| Sensitizing dye SD-4 | $4.5 \times 10^{-4}$ (mole/mole Ag) |
| Sensitizing dye SD-5 | $1.0 \times 10^{-4}$ (mole/mole Ag) |
| Magenta coupler M-2 | 0.09 |
| Colored magenta coupler CM-2 | 0.03 |
| DIR compound D-3 | 0.05 |
| High boiling solvent Oil-2 | 0.3 |
| Gelatin | 1.0 |
| 8th layer: yellow filter layer YC | |
| Yellow colloidal silver | 0.1 |
| Antistain agent SC-1 | 0.1 |
| High boiling solvent Oil-3 | 0.1 |
| Gelatin | 0.8 |
| 9th layer: low speed blue-sensitive emulsion layer BL | |
| Silver iodobromide emulsion Em-4 | 0.6 |
| Sensitizing dye SD-6 | $7.0 \times 10^{-4}$ (mole/mole Ag) |
| Yellow coupler Y-1 | 0.5 |
| Yellow coupler Y-2 | 0.2 |
| DIR compound D-2 | 0.025 |
| High boiling solvent Oil-3 | 0.3 |
| Gelatin | 1.0 |
| 10th layer: high speed blue-sensitive emulsion layer BH | |
| Silver iodobromide emulsion Em-5 | 0.6 |
| Sensitizing dye SD-6 | $3.5 \times 10^{-4}$ (mole/mole Ag) |
| Yellow coupler Y-1 | 0.20 |
| High boiling solvent Oil-3 | 0.07 |
| Gelatin | 0.8 |
| 11th layer: 1st protective layer PRO-1 | |
| Fine grain silver iodobromide emulsion (average grain size: 0.08 μm, AgI content: 2 mole %) | 0.4 |
| UV absorbent UV-1 | 0.10 |
| UV absorbent UV-2 | 0.05 |
| High boiling solvent Oil-1 | 0.1 |
| High boiling solvent Oil-4 | 0.1 |
| Formalin scavenger HS-1 | 0.5 |
| Formalin scavenger HS-2 | 0.2 |
| Gelatin | 1.0 |
| 12th layer: 2nd protective layer | |
| Alkali soluble matting agent (average particle size: 2 μm) | 0.15 |
| Polymethylmethacrylate (average particle size: 3 μm) | 0.05 |
| Gelatin | 0.50 |

Besides the above compositions, coating aids Su-1, Su-2, dispersants Su-3, Su-4, hardeners H-1, H-2, slipping agent WAX-1, stabilizer ST-1 and antifoggants AF-1 (Mw: 10,000), AF-2 (Mw: 1,1000,000) were added.

The emulsions used in the above sample were as follows:

Em-1

A monodispersed layered-structure type silver iodobromide emulsion comprised of grains having an average grain size of 0.27 μm, an average silver iodide content of 7 mole %, a grain size distribution extent of 18% and an outer phase silver iodide content of 2 mole %.

Em-2

A monodispersed layered-structure type silver iodobromide emulsion comprised of grains having an average grain size of 0.40 μm, an average silver iodide content of 7 mole %, a grain size distribution extent of 18% and an outer phase silver iodide content of 0.5 mole %.

Em-4

A monodispersed layered-structure type silver iodobromide emulsion comprised of grains having an average grain size of 0.23 μm, an average silver iodide content of 3.0 mole %, a grain size distribution extent of 17% and an outer phase silver iodide content of 1.0 mole %.

Em-5

A monodispersed layered-structure type silver iodobromide emulsion comprised of grains having an average grain size of 0.45 μm, an average silver iodide content of 3.0 mole %, a grain size distribution extent of 16%, and an outer phase silver iodide content of 1.0 mole %.

The compounds used in the above sample were as follows:

SD-1

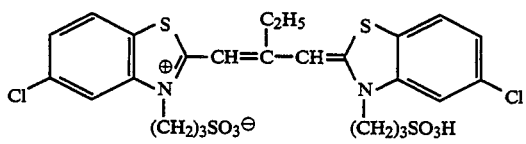

SD-2

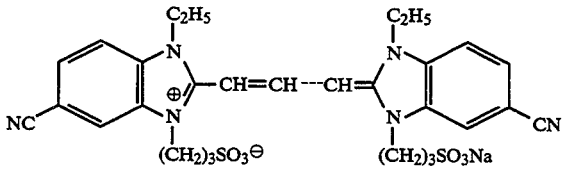

SD-3

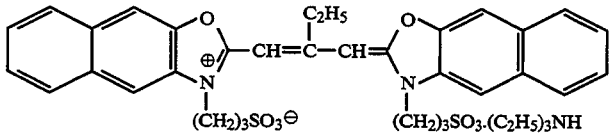

SD-4

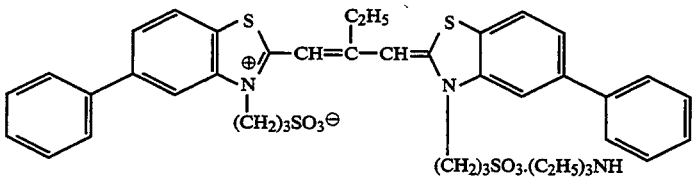

SD-5

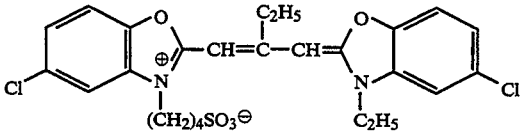

SD-5

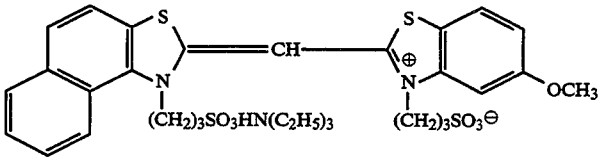

C-1

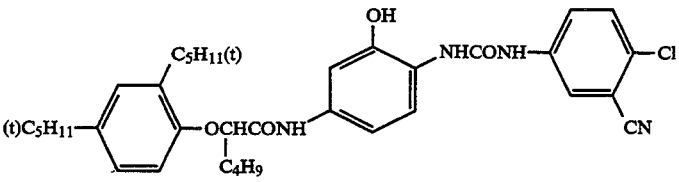

-continued
C-2
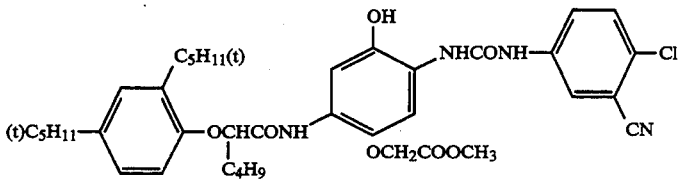
C-1
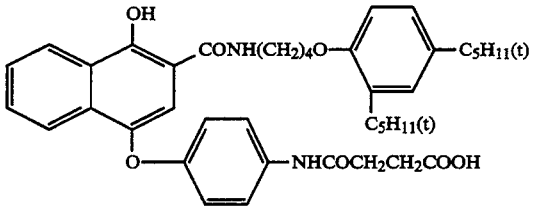
M-1
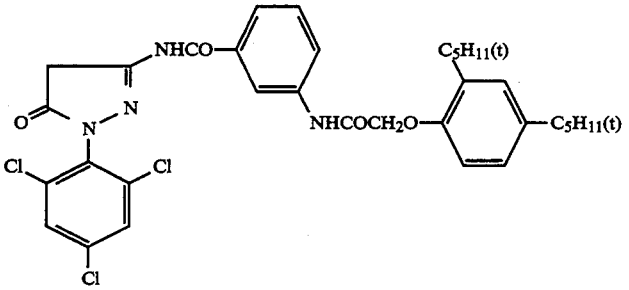
M-2
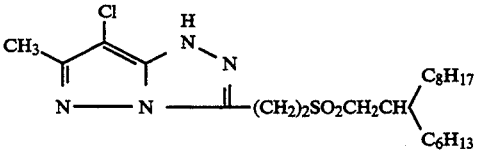
Y-1
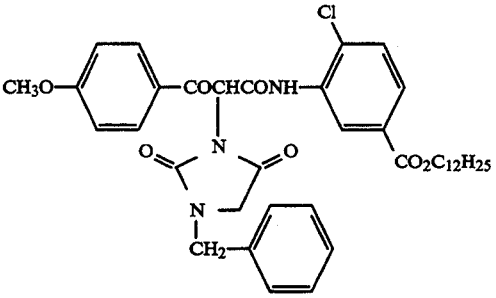
Y-2
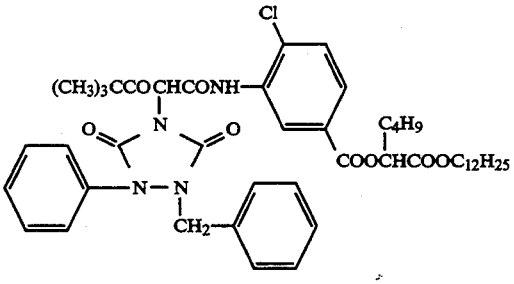

-continued
CC-1
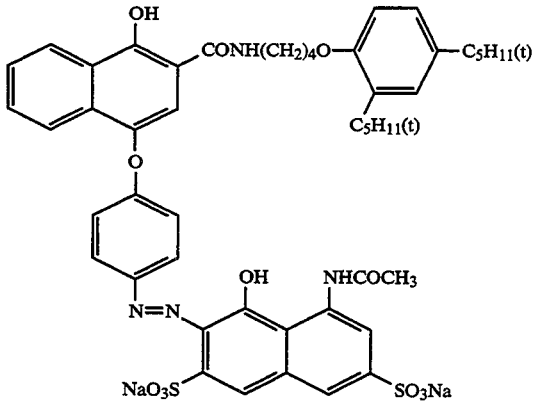
CM-1
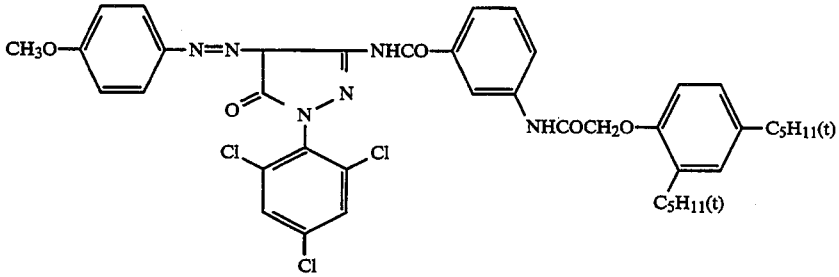
CM-2
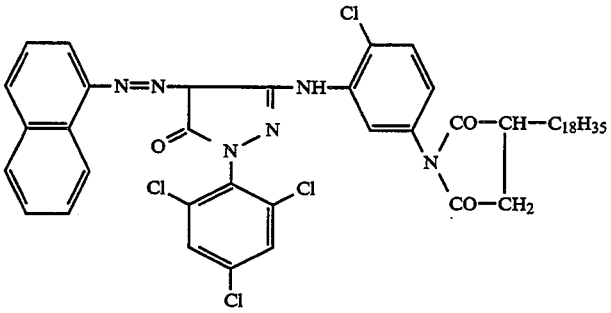
D-1
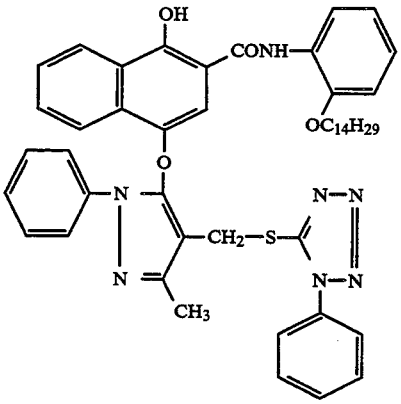

-continued
D-2
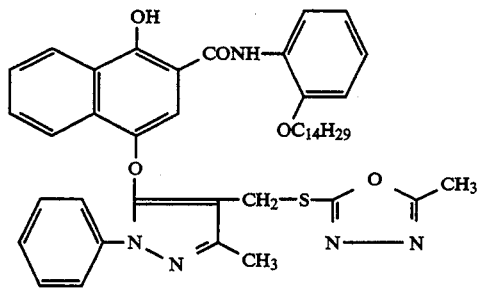
D-3
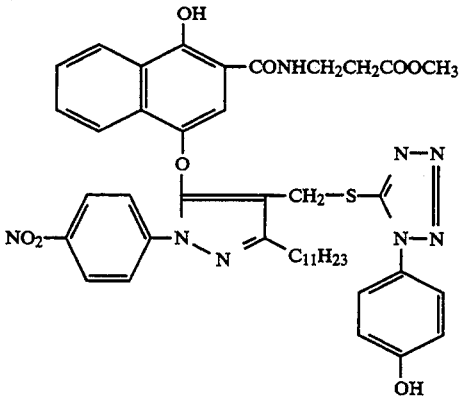
D-4
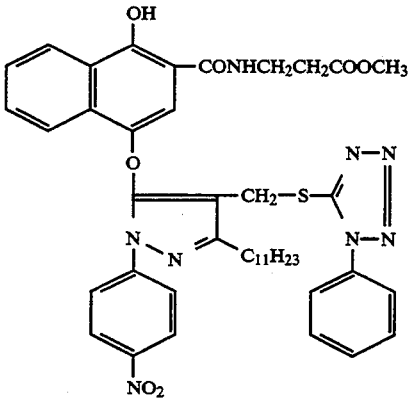
UV-1
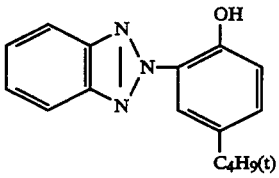
UV-2
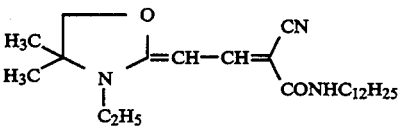
HS-1
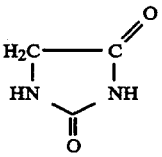

-continued
HS-2
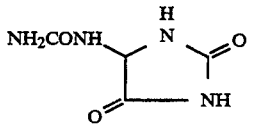
H-1
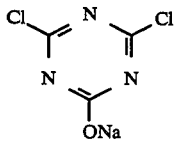
H-2
$(CH_2{=}CHSO_2CH_2)_2O$
Su-1
$NaOS{-}CH(CH_2COOCH_2(CF_2CF_2)_3H)COOCH_2(CF_2CF_2)_3H$
Su-2
$NaO_3S{-}CH(CH_2COOC_8H_{17})COOC_8H_{17}$
Su-3
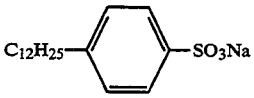
Su-4
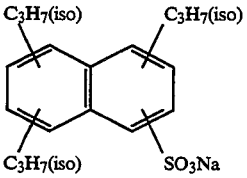
SC-1
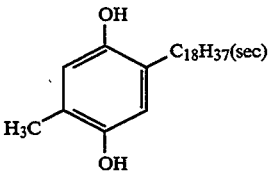
WAX-1
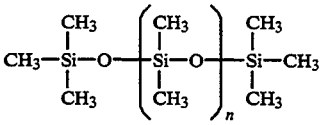
Weight average molecular weight = 3,000
Oil-1
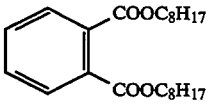
Oil-2
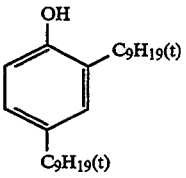
Oil-3
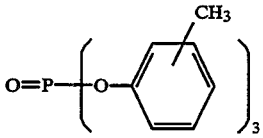

-continued

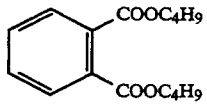

Oil-4

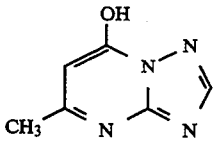

ST-1

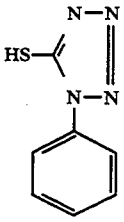

AF-1

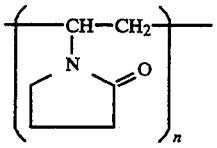

n = degree of polymerization

Samples 102 to 104 were prepared in the same procedure as with sample 101, except that the sensitizing dyes used in the 9th and 10th layers were changed as shown in Table 1.

Each of the photographing color negative samples was processed under the following conditions.

| Processing (at 38° C.) | |
|---|---|
| Color developing | 3 min 15 sec |
| Bleaching | 6 min 30 sec |
| Washing | 3 min 15 sec |
| Fixing | 6 min 30 sec |
| Washing | 3 min 15 sec |
| Drying | 1 min 30 sec |

The compositions of processing solutions used in the above processing were as follows:

| Color developer | |
|---|---|
| 4-amino-3-methyl-N-ethyl-N-(β-hydroxyethyl)-aniline sulfate | 4.75 g |
| Anhydrous sodium sulfite | 4.25 g |
| Hydroxylamine sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |

Water is added to make 1 liter, and then the pH is adjusted to 10.1.

| Bleacher | |
|---|---|
| Ammonium ferric ethylenediaminetetracetate | 100.0 g |
| Diammonium ethylenediaminetetracetate | 10.0 g |
| Ammonium bromide | 150.0 g |
| Glacial acetic acid | 10.0 ml |
| Water is added to make 1 liter, and the pH is adjusted to 6.0 with aqueous ammonia. | |

Water is added to make 1 liter, and the pH is adjusted to 6.0 with an aqueous ammonia.

| Fixer | |
|---|---|
| Ammonium thiosulfate | 175.0 g |
| Anhydrous sodium sulfite | 8.5 g |
| Sodium metasulfite | 2.3 g |

Water is added to make 1 liter, and the pH is adjusted to 6.0 with acetic acid.

| Stabilizer | |
|---|---|
| Formalin (37% aqueous solution) | 1.5 ml |
| Koniducks made by Konica Corp. | 7.5 ml |

Water is added to make 1 liter.

Printing color light-sensitive material P-1 was prepared in the following procedure.

Preparation of Printing Light-sensitive Material P-1

A multilayer silver halide color photographic light-sensitive material, P-1, was prepared by forming the layers of the following compositions on the titanium-dioxide-containing polyethylene side of a paper support, which was laminated with polyethylene on one side and with titanium-dioxide-containing polyethylene on the other side. The coating solutions for respective layers were prepared in the following manners.

Coating Solution for 1st Layer

A mixture of 26.7 g of yellow coupler Y-3, 10.0 g of dye image stabilizer ST-1, 6.67 g of dye image stabilizer ST-2, 0.67 g of additive HQ-1, 0.01 g of anti-irradiation dye AI-3 and 6.67 g of high boiling solvent DNP was dissolved in 60 ml of ethyl acetate. Then, the solution was dispersed with a supersonic homogenizer in 220 ml of 10% aqueous gelatin solution containing 7 ml of 20% surfactant Su-5 to obtain a yellow coupler dispersion. Subsequently, the dispersion was mixed with a blue-sensitive silver halide emulsion (containing 8.68 g of silver) prepared in the procedure described later. A coating solution for the 1st layer was thus obtained.

Coating solutions for the 2nd to 7th layers were prepared in similar manners as with the coating solution for the 1st layer.

As a hardener, H-3 was used in the 2nd and 4th layers, and H-1 in the 7th layer. Surfactants Su-6 and Su-7 were used as a coating aid to adjust the surface tension. In the following layer compositions, the addition amount to the light-sensitive material is in grams per $m^2$ unless otherwise specified.

| | |
|---|---|
| 7th layer: (protective layer) | |
| Gelatin | 1.00 |
| DIDP | 0.005 |
| Additive HQ-2 | 0.002 |
| Additive HQ-3 | 0.002 |
| Additive HQ-4 | 0.004 |
| Additive HQ-5 | 0.02 |
| Compound F-1 | 0.002 |
| 6th layer: (UV absorbing layer) | |
| Gelatin | 0.40 |
| UV absorbent UV-3 | 0.10 |
| UV absorbent UV-4 | 0.04 |
| UV absorbent UV-5 | 0.16 |
| Additive HQ-5 | 0.04 |
| DNP | 0.20 |
| PVP | 0.03 |
| Anti-irradiation dye AI-2 | 0.02 |
| Anti-irradiation dye AI-4 | 0.01 |
| 5th layer: (red-sensitive layer) | |
| Gelatin | 1.30 |
| Red-sensitive silver chlorobromide emulsion Em-R | 0.21 |
| Cyan coupler C-3 | 0.17 |
| Cyan coupler C-4 | 0.25 |
| Dye image stabilizer ST-1 | 0.20 |

-continued

| | |
|---|---|
| Additive HQ-1 | 0.01 |
| HBS-1 | 0.20 |
| DOP | 0.20 |
| 4th layer: (UV absorbing layer) | |
| Gelatin | 0.94 |
| UV absorbent UV-3 | 0.28 |
| UV absorbent UV-4 | 0.09 |
| UV absorbent UV-5 | 0.38 |
| Additive HQ-5 | 0.10 |
| DNP | 0.40 |
| 3rd layer: (green-sensitive layer) | |
| Gelatin | 1.40 |
| Green-sensitive silver chlorobromide emulsion Em-G | 0.17 |
| Magenta coupler M-3' | 0.35 |
| Dye image stabilizer ST-3 | 0.20 |
| Dye image stabilizer ST-4 | 0.17 |
| DIOP | 0.13 |
| DBP | 0.13 |
| Anti-irradiation dye AI-1 | 0.01 |
| 2nd layer: (intermediate layer) | |
| Gelatin | 1.20 |
| Additive HQ-2 | 0.03 |
| Additive HQ-3 | 0.03 |
| Additive HQ-4 | 0.05 |
| Additive HQ-5 | 0.23 |
| DIDP | 0.06 |
| Compound F-1 | 0.002 |
| 1st layer: (blue-sensitive layer) | |
| Gelatin | 1.20 |
| Blue-sensitive silver chlorobromide emulsion Em-B | 0.26 |
| Yellow coupler Y-3 | 0.80 |
| Dye image stabilizer ST-1 | 0.30 |
| Dye image stabilizer ST-2 | 0.20 |
| Additive HQ-1 | 0.02 |
| Anti-irradiation dye AI-3 | 0.01 |
| DNP | 0.20 |
| Support | |
| Polyethylene-laminated paper | |

*The amount of the silver halide emulsion is given in an amount of silver contained.

Y-3

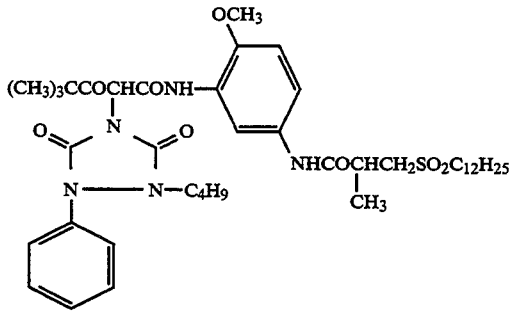

M-3'

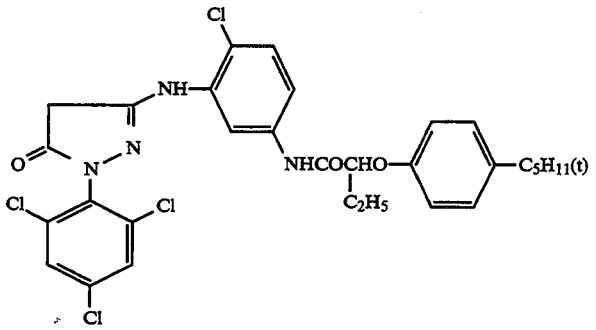

-continued
C-3
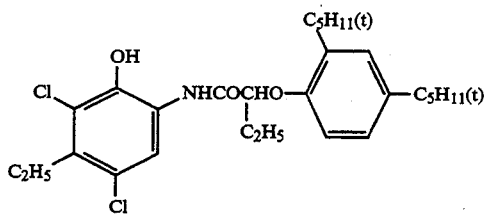
C-4
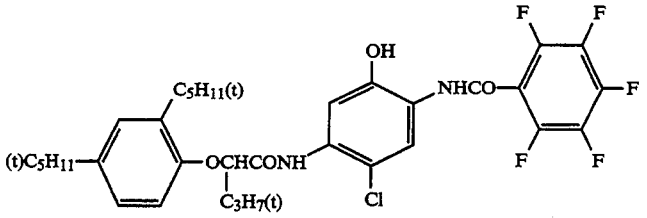
ST-1
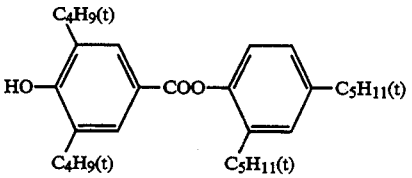
ST-2
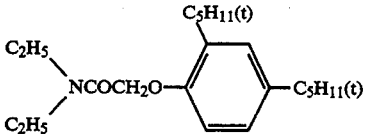
ST-3
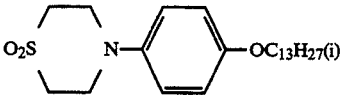
ST-4
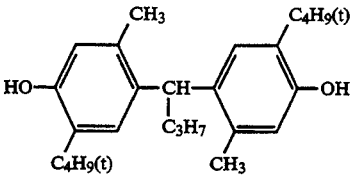
UV-3
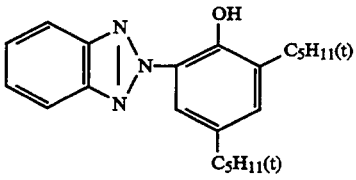
UV-4
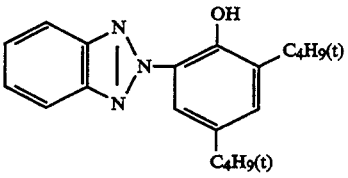
UV-5
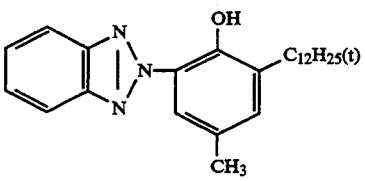
DBP Dibutyl phthalate -continued
| | |
|---|---|
| DOP | Dioctyl phthalate |
| DNP | Dinonyl phthalate |
| DIDP | Diisodecyl phthalate |
| PVP | Polyvinyl pyrrolidone |
HQ-1
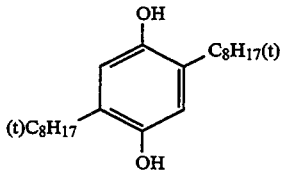
HQ-2
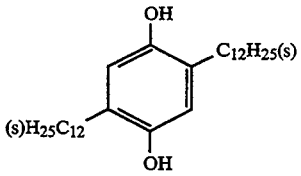
HQ-3
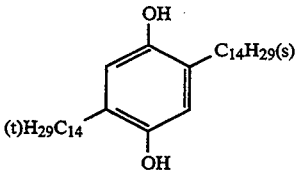
HQ-4
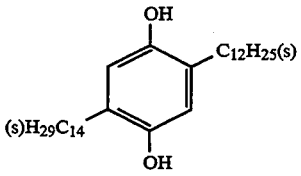
HQ-5
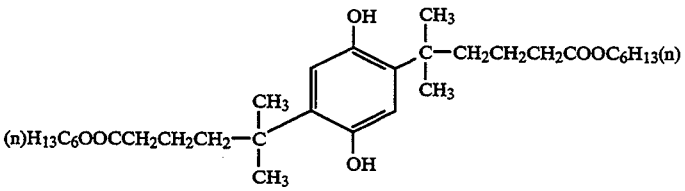
HBS-1
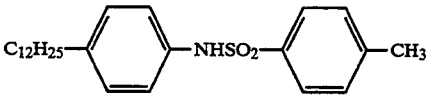
AI-1
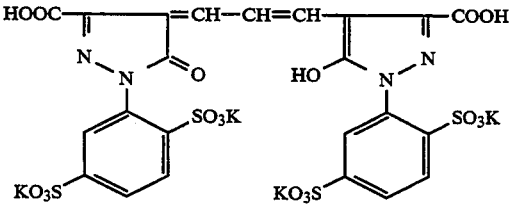
AI-2
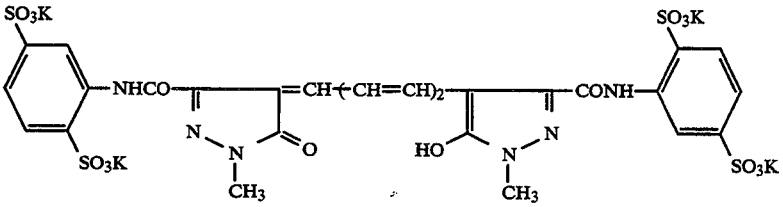

-continued

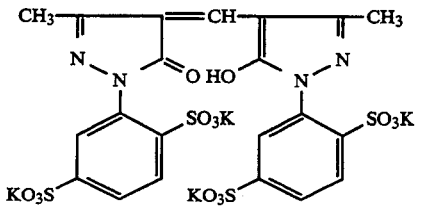

AI-3

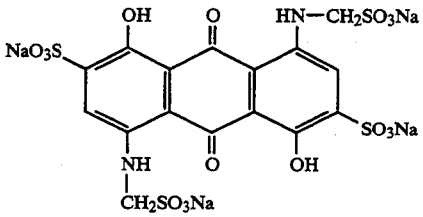

AI-4

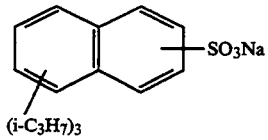

SU-5

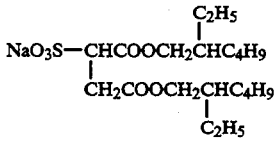

SU-6

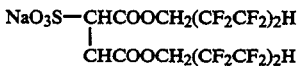

SU-7

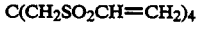

H-3

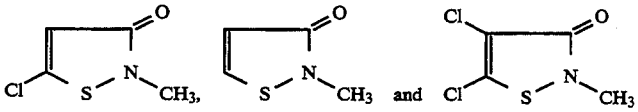

F-1

(50%) (46%) and (4%) molar ratio

Preparation of Blue-Sensitive Silver Halide Emulsion

To 1000 ml of 2% aqueous gelatin solution kept at 40° C. were simultaneously added the following solutions A and B over a period of 30 minutes, while controlling the reaction liquor at pAg 6.5 and pH 3.0. Then, solutions C and D were added thereto over a period of 180 minutes, while controlling the pAg and pH at 7.3 and 5.5, respectively.

The control of the pH was made by use of sulfuric acid or an aqueous solution of sodium hydroxide. The pAg was controlled by the addition of a controlling solution, which was prepared by dissolving sodium chloride and potassium bromide in water at a chlorine ion to bromine ion ratio of 99.8 to 0.2. This controlling solution was used at a concentration of 0.1 mole/liter when solutions A and B were mixed, and 1 mole/liter when solutions C and D were mixed.

| | |
|---|---|
| Solution A | |
| Sodium chloride | 3.42 g |
| Potassium bromide | 0.03 g |
| Water was added to make | 200 ml |
| Solution B | |

-continued

| | |
|---|---|
| Silver nitrate | 10 g |
| Water was added to make | 200 ml |
| Solution C | |
| Sodium chloride | 102.7 g |
| Potassium bromide | 1.0 g |
| Water was added to make | 600 ml |
| Solution B | |
| Silver nitrate | 300 g |
| Water was added to make | 600 ml |

After the addition, the product was subjected to desalting by use of a 5% aqueous solution of Demol N made by Kao Atlas Co. and a 20% aqueous solution of magnesium sulfate, and then mixed with an aqueous gelatin solution to obtain emulsion EMP-1. The resultant emulsion was comprised of monodispersed cubic grains having an average grain size of 0.85 μm, a grain size variation coefficient ($\sigma/r$) of 0.07 and a silver chloride content of 99.5 mole %.

Subsequently, emulsion EMP-1 was chemically sensitized for 90 minutes at 50° C. in the presence of the following compounds to obtain blue-sensitive silver halide emulsion Em-B.

| | |
|---|---|
| Sodium thiosulfate | 0.8 mg/mole AgX |
| Chloroauric acid | 0.5 mg/mole AgX |
| Stabilizer STAB-1 | $6 \times 10^{-4}$ mole/mole AgX |
| Sensitizing dye BS-1 | $4 \times 10^{-4}$ mole/mole AgX |
| Sensitizing dye BS-2 | $1 \times 10^{-4}$ mole/mole AgX |

Preparation of Green-Sensitive Silver Halide Emulsion

Emulsion EMP-2 was prepared in the same manner as with EMP-1, except that the addition time of solutions A & B and that of solutions C & D were changed. The resultant emulsion EMP-2 was comprised of monodispered cubic grains having an average grain size of 0.43 μm, a grain size variation coefficient (σ/r) of 0.08 and a silver chloride content of 99.5 mole %.

Then, emulsion EMP-2 was chemically sensitized for 120 minutes at 55° C. by use of the following compounds. Green-sensitive silver halide emulsion Em-G was thus prepared.

| | |
|---|---|
| Sodium thiosulfate | 1.5 mg/mole AgX |
| Chloroauric acid | 1.0 mg/mole AgX |
| Stabilizer STAB-1 | $6 \times 10^{-4}$ mole/mole AgX |
| Sensitizing dye GS-1 | $4 \times 10^{-4}$ mole/mole AgX |

Emulsion EMP-3 was prepared in the same manner as with EMP-1, except that the addition time of solutions A & B and that of solutions C & D were changed. Emulsion EMP-3 thus obtained was comprised of monodispered cubic grains having an average grain size of 0.50 μm, a grain size variation coefficient (σ/r) of 0.08 and a silver chloride content of 99.5 mole %.

Emulsion EMP-2 was then chemically sensitized for minutes at 60° C. by use of the following compounds, so that red-sensitive silver halide emulsion Em-R was obtained.

| | |
|---|---|
| Sodium thiosulfate | 1.8 mg/mole AgX |
| Chloroauric acid | 2.0 mg/mole AgX |
| Stabilizer STAB-1 | $6 \times 10^{-4}$ mole/mole AgX |
| Sensitizing dye RS-1 | $1 \times 10^{-4}$ mole/mole AgX |

The grain size variation coefficient (σ/r) used here can be calculated from the standard deviation (σ) given by the following expression and the average grain size (r).

$$\sigma = \sqrt{\frac{\Sigma(ri - r)^2}{\Sigma ni}}$$

where, ri is a grain size, and ni is the number of grains whose size is ri.

BS-1

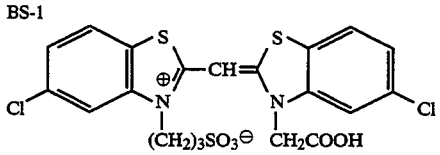

BS-2

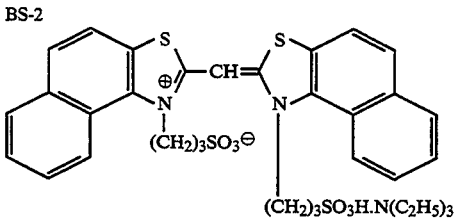

GS-1

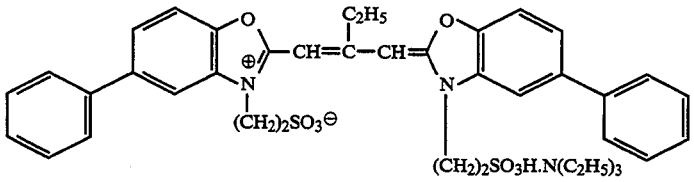

RS-1

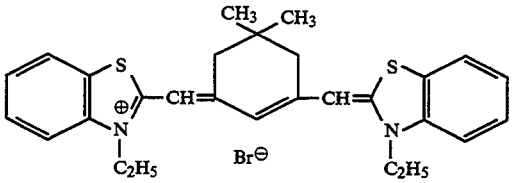

STAB-1

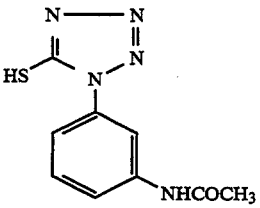

In a similar procedure as with sample P-1, sample P-2 was prepared by replacing magenta coupler M-3 used in the 3rd layer of sample P-1 with a molar equivalent of magenta coupler M-2, and sample P-3 was prepared likewise by replacing M-3 with a molar equivalent of M-6.

Each of them was processed under the following conditions.

| Processing | Temperature (°C.) | Time |
|---|---|---|
| Color developing | 35.0 ± 0.3 | 45 sec |
| Bleach-fixing | 35.0 ± 0.5 | 45 sec |
| Stabilizing | 30 to 34 | 90 sec |
| Drying | 60 to 80 | 60 sec |

| Color developer | |
|---|---|
| Deionized water | 800 ml |
| Triethanolamine | 10 g |
| N,N-diethylhydroxylamine | 5 g |
| Potassium bromide | 0.02 g |

-continued

| | |
|---|---|
| Potassium chloride | 2 g |
| Potassium sulfite | 0.3 g |
| 1-Hydroxyethylidene-1,1-diphosphonic acid | 1.0 g |
| Ethylenediaminetetracetic acid | 1.0 g |
| Disodium catechol-3,5-disulfonate | 1.0 g |
| Diethylene glycol | 10 g |
| N-ethyl-N-β-methanesulfonamidoethyl-3-methyl-4-aminoaniline sulfate | 4.5 g |
| Optical whitening agent (4,4'-diaminostilbene sulfonate derivative) | 1.0 g |
| Potassium carbonate | 27 g |
| Water is added to make 1 liter, and the pH is adjusted to 10.10. | |
| Bleach-fixer | |
| Ammonium ferric ethylenediaminetetracetate dihydrate | 60 g |
| Ethylenediaminetetracetic acid | 100 ml |
| ammonium thiosulfate (70% aqueous solution) | |
| Ammonium sulfite (40% aqueous solution) | 27.5 ml |

Water is added to make 1 liter, then the pH is adjusted to 5.7 with potassium carbonate or glacial acetic acid.

| Stabilizer | |
|---|---|
| 5-Chloro-2-methyl-4-isothiazoline-3-one | 0.2 g |
| 1,2-benzisothiazoline-3-one | 0.3 g |
| Ethylene glycol | 1.0 g |
| 1-Hydroxyethylidene-1,1-diphosphonic acid | 2.0 g |
| Sodium o-phenylphenoxide | 1.0 g |
| Ethylenediaminetetracetic acid | 1.0 g |
| Aqueous ammonia (20% solution) | 3.0 g |
| Optical whitening agent (4,4'-diaminostilbene sulfonate derivative) | 1.5 g |

Water is added to make 1 liter, and the pH is adjusted to 7.0 with sulfuric acid or potassium hydroxide.

For the photographing color negative film samples 101 to 104, the spectral sensitivity distribution was determined by subjecting each sample to homochromatic exposure in the manner described in the foregoing paragraph and processing the exposed sample.

The wavelength which gives the maximum spectral sensitivity to the blue-sensitive layer, and the spectral sensitivity at 480 nm relative to the maximum spectral sensitivity which is set at 100, are shown in Table 1. The spectral sensitivity distribution of sample 102 is shown in FIG. 2.

A blue-green cloth having a spectrum shown in FIG. 1 and a color rendition chart made by Macbeth Co. (a color chart comprised of 18 colored patterns and 6 uncolored patterns) were photographed with each of film samples 101 to 104, followed by processing under the foregoing conditions. Then, the image on each film sample was printed on each of the printing color light-sensitive materials (P-1) to (P-3), under such conditions that the gray of density 0.7 in the color chart was reproduced in the same density, followed by processing under the foregoing conditions.

The printed color of the blue-green cloth was visually compared with the original color. Further, the reproduced colors of Macbeth's color rendition chart on the print were measured with a CMS-1200 color analyzer made by Murakami Shikisai Co., and the average of color differences between the reproduced 18 blue-greens and the original 18 colors was determined by use of the CIE 1976 L*a*b* color difference formula. The results are shown in Table 2. The color difference used here indicates the distance between an original color and a reproduced color on a chromaticity coordinate, and the reproduced color becomes closer to the original color the smaller the value is.

TABLE 1

| | Photographing color negative film | | | | | | |
|---|---|---|---|---|---|---|---|
| | | 9th layer | | 10th layer | | | $\lambda_B$480 |
| Printing experiment No. | Sample No. | Dye No. | Amount mole/Ag mole | Dye No. | Amount mole/Ag mole | $\lambda_B$max nm | λBmax ×100% |
| 1 | 101 | SD-6 | $7.0 \times 10^{-4}$ | SD-6 | $3.5 \times 10^{-4}$ | 465 | 50 |
| 2 | 101 | SD-6 | $7.0 \times 10^{-4}$ | SD-6 | $3.5 \times 10^{-4}$ | 465 | 50 |
| 3 | 102 | A-7 | $7.0 \times 10^{-4}$ | A-7 | $3.5 \times 10^{-4}$ | 455 | 20 |
| 4 | 102 | A-7 | $7.0 \times 10^{-4}$ | A-7 | $3.5 \times 10^{-4}$ | 455 | 20 |
| 5 | 103 | Not used | 0 | Not used | 0 | 412 | 20 |
| 6 | 104 | A-1 | $7.0 \times 10^{-4}$ | A-1 | $3.5 \times 10^{-4}$ | 460 | 30 |
| 7 | 102 | A-7 | $7.0 \times 10^{-4}$ | A-7 | $3.5 \times 10^{-4}$ | 455 | 20 |

As apparent from Tables 1 and 2, print Nos. 4, 6 and 7 having the constitution of the invention are not only excellent in reproduction of blue-green but also low in the average color difference of the 18 color reproductions, and thus capable of reproducing colors closer to originals. Print No. 5 prepared by use of sample 103 is good in blue-green reproduction but not satisfactory for its large color difference in reproduction of the 18 colors.

Figure 1:
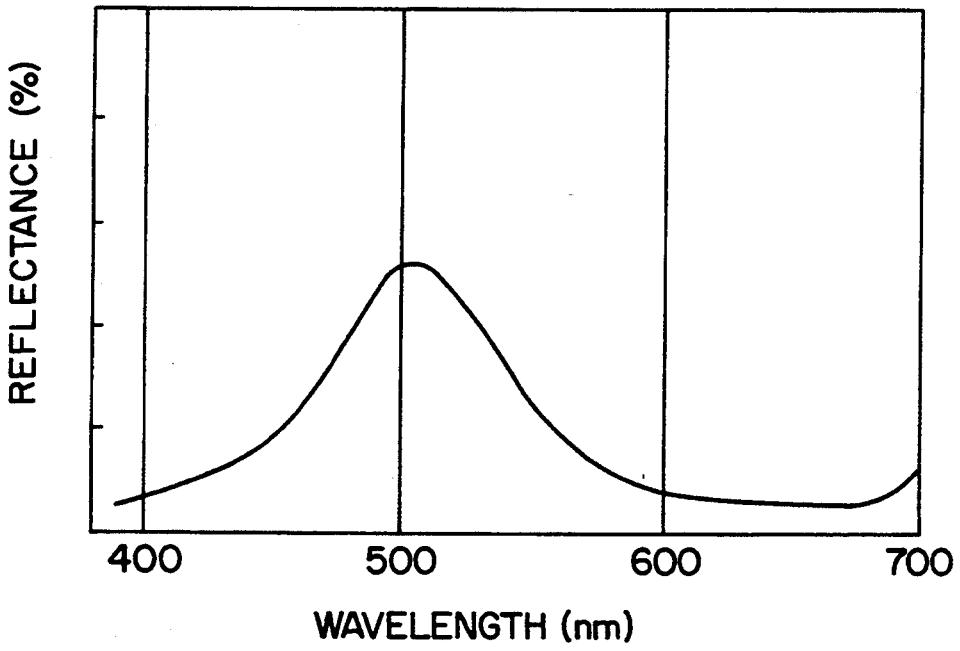
FIG. 1 is a graph showing a reflectance spectrum of the blue-green cloth.
Figure 2:
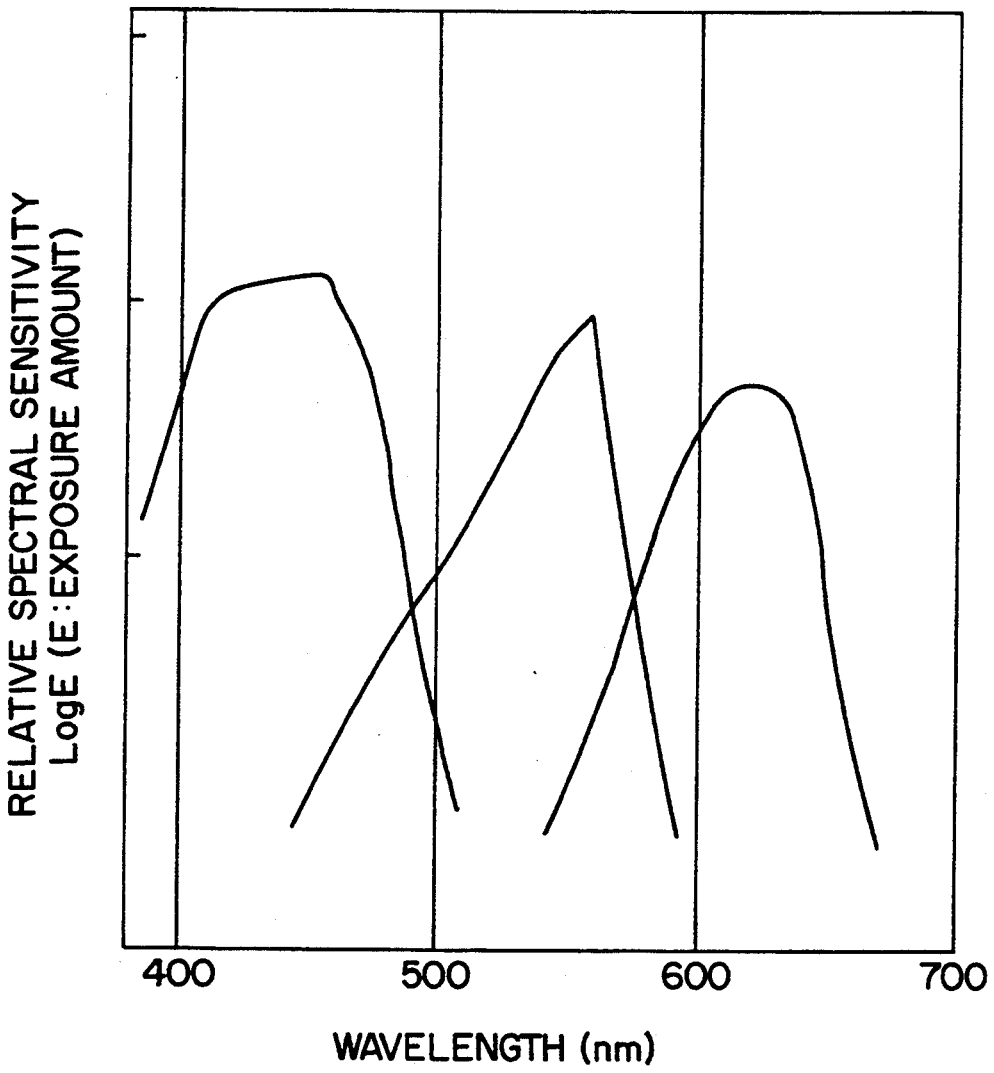
FIG. 2 is a graph showing a spectral sensitivity distribution (Dmin+0.7) curve of sample 102.

What is claimed is;

1. A method for forming a color photographic image comprising the steps of:

imagewise exposing a negative photographic light-sensitive material comprising a support having provided thereon a blue-sensitive silver halide emulsion layer, a green-sensitive silver halide emulsion layer, and a red-sensitive silver halide emulsion layer to form an exposed negative material, and developing, bleaching, fixing, washing, and drying said exposed negative material to form a permanent negative material, and using the permanent negative material to expose a printing silver halide color photographic light-sensitive material comprising a support having provided thereon a yellow color forming layer, a magenta color forming layer, and a cyan color forming layer to form an exposed printing color photographic light-sensitive material, and developing said exposed printing color photographic light-sensitive material, wherein the negative material meets requirement (A), and the print material fulfills requirement (B);

(A) the wavelength $\lambda_B^{max}$, a maximum value in the spectral sensitivity distribution of said blue-sensitive silver halide emulsion layer, is from 415 nm to 470 nm, and the sensitivity of said blue-sensitive emulsion layer at 480 nm is not more than 25% of its sensitivity at $\lambda_B^{max}$, (B) a magenta color forming layer of the printing color photographic light-sensitive material comprises a magenta coupler represented by Formula 1;

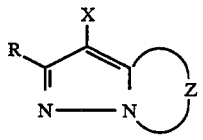

Formula 1 wherein Z represents a group of non-metal atoms necessary to form a nitrogen-containing heterocyclic ring, which may have a substituent, X represents hydrogen or a group capable of being split off by reaction with an oxidation product of a color developing agent, and R represents hydrogen or a substituent.

2. A method for forming color photographic images as defined by claim 1, wherein said wavelength $\lambda_B^{max}$ to give the maximum value in spectral sensitivity distribution of said blue-sensitive silver halide emulsion layer is within the limits of 420 nm to 460 nm.

3. A method for forming color photographic images as defined by claim 1, wherein a magenta coupler selected from the compounds represented by Formula 1;

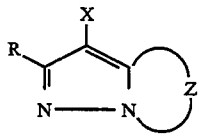

Formula 1 wherein Z represents a group of non-metal atoms necessary to form a nitrogen-containing heterocyclic ring, which may have a substituent, X represents a hydrogen atom, or a group capable of undergoing a splitting off reaction with an oxidation product of a color developing agent, R represents a hydrogen atom, an alkyl group, an aryl group, an anilino group, an acylamino group, a sulfonamido group, an alkylthio group, arylthio group, an alkenyl group, a cycloalkyl group, a halogen atom, a cycloalkenyl group, an alkynyl group, a heterocyclic group, a sulfonyl group, a sulfinyl group, a phosphonyl group, an acyl group, a carbamoyl group, a sulfamoyl group, a cyano group, an alkoxy group, an aryloxy group, a heterocyclicoxy, a siloxy group, an acyloxy group, a carbamoyloxy group, an amino group, an alkylamino group, a ureido group, a sulfamoylamino group, an alkoxycarbonylamino group, an aryloxycarbonylamino group, an alkoxycarbonyl group, an aryloxycarbonyl group, a heterocyclicthio group, a spirocompound radical, a bridged hydrocarbon radical.

4. The method of claim 1 further comprising bleach-fixing of said printing color photographic light-sensitive material.

5. The method of claim 4 further comprising stabilizing and drying of said printing color photographic light-sensitive material.

* * * * *